US007715768B2

(12) United States Patent
Shinohara

(10) Patent No.: US 7,715,768 B2
(45) Date of Patent: May 11, 2010

(54) COLOR IMAGE FORMING DEVICE

(75) Inventor: Tadashi Shinohara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 825 days.

(21) Appl. No.: 11/496,510

(22) Filed: Aug. 1, 2006

(65) Prior Publication Data

US 2007/0025779 A1 Feb. 1, 2007

(30) Foreign Application Priority Data

Aug. 1, 2005 (JP) ..... 2005-222813

(51) Int. Cl.
*G03G 15/01* (2006.01)

(52) U.S. Cl. ..... 399/301; 347/116; 399/49; 399/72

(58) Field of Classification Search ..... 399/72, 399/49, 301; 347/116
See application file for complete search history.

(56) References Cited

U.S. PATENT DOCUMENTS

| | | | |
|---|---|---|---|
| 5,737,665 | A | 4/1998 | Sugiyama et al. |
| 5,765,083 | A | 6/1998 | Shinohara |
| 6,118,557 | A | 9/2000 | Sugiyama et al. |
| 6,128,459 | A | 10/2000 | Iwata et al. |
| 6,282,396 | B1 | 8/2001 | Iwata et al. |
| 6,295,435 | B1 | 9/2001 | Shinohara et al. |
| 6,380,960 | B1 | 4/2002 | Shinohara |
| 6,381,435 | B2 | 4/2002 | Shinohara et al. |
| 6,573,918 | B2 | 6/2003 | Kobayashi et al. |
| 6,693,654 | B2 | 2/2004 | Shinohara |
| 6,704,035 | B2 | 3/2004 | Kobayashi et al. |
| 6,711,364 | B2 | 3/2004 | Shinohara |
| 2003/0137577 | A1 | 7/2003 | Shinohara |
| 2004/0041896 | A1 | 3/2004 | Shinohara |
| 2005/0009351 | A1 | 1/2005 | Takahashi et al. |
| 2005/0088505 | A1 | 4/2005 | Shinohara |
| 2005/0200689 | A1 | 9/2005 | Shinohara et al. |
| 2005/0238372 | A1 | 10/2005 | Shinohara |
| 2006/0164497 | A1 | 7/2006 | Shinohara |
| 2006/0263120 | A1* | 11/2006 | Hayakawa ..... 399/301 |

FOREIGN PATENT DOCUMENTS

| | | |
|---|---|---|
| JP | 63-73277 | 2/1988 |
| JP | 7-219303 | 8/1995 |
| JP | 10-213940 | 8/1998 |
| JP | 2004-69909 | 3/2004 |
| JP | 2004-101567 | 4/2004 |
| JP | 2004-117896 | 4/2004 |

* cited by examiner

*Primary Examiner*—David P Porta
*Assistant Examiner*—Bryan P Ready
(74) *Attorney, Agent, or Firm*—Oblon, Spivak, McClelland, Maier & Neustadt, L.L.P.

(57) ABSTRACT

A color image forming device comprises a plurality of first image support mediums, a scanning exposure unit, a second image support medium, a second-image-support-medium transport unit, a transfer unit, a correction-pattern-image forming unit, a pattern measurement unit, and a control unit. The correction-pattern-image forming unit is configured to reduce the total time for forming a sequence of correction pattern images of color components.

9 Claims, 13 Drawing Sheets

COLOR IMAGE FORMING DEVICE

BACKGROUND OF THE INVENTION

1. Field of the Invention

The present invention relates to a tandem-type color image forming device, such as a laser printer, a digital copier or a facsimile device, in which color component images are written to respective photoconductors through light beam scanning and a color image is formed on an image support medium through superimposing of the color component images. More particularly, the present invention relates to a color image forming device which is provided with a correction-pattern image forming unit adapted for correction of the image formation operating states for each color component.

2. Description of the Related Art

In recent years, in image forming devices, such as a printer, a digital copier and a facsimile device, which perform image formation by using the electrophotographic process, the light scanning method which performs the optical image writing to the photoconductor by the scanning of a light beam (e.g., laser beam) is commonly used. In this light scanning method, the photoconductor is periodically scanned in the main scanning direction by the scanning unit, such as a polygon mirror, through the scanning of a laser beam the light emission control of which is performed in accordance with a video signal (line image signal). And the scanned surface of the photoconductor is moved in the sub-scanning direction (which is perpendicular to the main scanning direction). A two-dimensional image is formed on the photoconductor by performing the exposure scanning.

Subsequently, the electrostatic latent image formed on the photoconductor by the exposure scanning is subjected to each of respective processes of the development using toner, the image transfer to a recording medium or copy sheet (which may include an intermediate transfer medium), and the fixing of the image to the recording medium. After these processes, the image formation processing is completed.

When a color image is formed using the light beam scanning method, the scanning of a light beam to the photoconductor is performed for each of respective color components, and a color composite image is produced through the superimposing the color-component images. Regarding this processing, there are known the two major methods. One is the single-photoconductor method in which the color superimposing is performed in the optical writing or image transfer process using the single photoconductor that is common to each color component. The other is the tandem type method in which the color superimposing is performed in the image transfer process using a plurality of photoconductors corresponding to the respective color components.

In the tandem type method, the exposure scanning is performed to the photoconductor of each color component respectively, and then the color superimposing is performed. And it is necessary to manage the image formation process so as to prevent occurrence of deviations between the respective color component images. For this reason, it is necessary to output an appropriate color image by measuring or detecting the image formation state of each of the color component images and adjusting the operating conditions in accordance with a detected change of the image formation state.

Japanese Published Application No. 07-019085, Japanese Patent No. 3644923, and Japanese Laid-Open Patent Application No. 2004-101567 disclose examples of the operating-state measurement method according to the related art which is used for the tandem type method.

The measurement method of Japanese Published Application No. 07-019085 is to measure a color deviation in the copy sheet transport direction by forming a pattern image of each color on the transport (transfer) belt, on the conditions that it is formed in the transport direction at predetermined intervals during operation without any error, and by detecting a change in the pattern image. That is, the pattern image of each color actually formed at the time of measurement reflects variations in the image formation operating states for each color and includes a positional deviation of the interval between the pattern images. This deviation is detected by a sensor, and the image write timing is adjusted in accordance with the detected signal from the sensor.

The measurement method of Japanese Patent No. 3644923 is based on the above-mentioned method of Japanese Published Application No. 07-019085 wherein the pattern image of each color is formed on the transport (transfer) belt. In this method, in addition to the positional deviation between the pattern images of the respective colors, other deviations, due to errors of a sub-scanning registration (or the above-mentioned deviation in the copy sheet transport direction), an inclination (skew), a main-scanning registration and a scanning magnification, are also included. For this reason, a sequence of positioning toner marks for detecting a deviation is formed at three detection positions on the transport belt arrayed in the main scanning direction.

Moreover, in the method of Japanese Patent No. 3644923, the optical density detection toner mark (patch) for optical density detection of each color is also formed, and the detection unit for detecting the positional deviation is shared for detection of this optical density detection toner mark.

In the measurement method of Japanese Laid-Open Patent Application No. 2004-101567, the processing of the detection data which optimizes positioning is performed on the basis of detection of the positioning toner marks for detection of positional deviation between the images of each color as in the method of Japanese Patent No. 3644923.

Based on the data which represents the measurement result of the operating state acquired by the measurement method as disclosed in Japanese Patent No. 3644923 or Japanese Laid-Open Patent Application No. 2004-101567, the correction is carried out and the operating conditions are adjusted so that a high-quality image without color deviation can be formed.

The above adjustment is carried out for the exposure scanning unit by adjusting the timing of image writing, the drive of the photoconductor or the amount of light exposure. Or the above adjustment is carried out for the toner development unit by adjusting the development bias or the charging bias. Since the state of the system changes temporally, the above adjustment must be performed at appropriate timing.

In the measurement method which detects the image formation operating state by measuring the toner marks, in order to derive various kinds of correction (adjustment) values of the respective colors or those needed between the respective colors from the detection result of the toner marks on the transport (transfer) belt by means of the sensor, the toner marks on the transport (transfer) belt are formed in accordance with the predetermined conditions for this purpose.

For example, FIG. 11 shows the arrangement of toner marks for detection of positional deviation between the respective colors according to the art related to the invention. As shown in FIG. 11, a mark sequence 17' which includes four lateral lines and four slanting lines of the respective colors arranged at predetermined intervals is set up as one group, and this mark sequence 17' is formed at each of detection positions of the sensors 14, 15 and 16 which are disposed on the transport belt at three different locations in the main scanning direction.

The mark sequence 17' shown in FIG. 11 is similar to the deviation detection toner marks as disclosed in Japanese Patent No. 3644923 or Japanese Laid-Open Patent Application No. 2004-101567. The letters M, C, Y and K indicated in the mark sequence in FIG. 11 denote the respective color components (M: magenta, C: cyan, Y: yellow, K: black).

The mark sequence 17' (or deviation detection marks) is formed on the transport belt during a special operation mode (which is called correction mode) which is performed to correct the image formation operating states, and this correction mode is different from the normal printing mode (which is also called normal printing) which is performed to form an image on a copy sheet.

In the tandem type color image forming device according to the related art, the toner marks are formed on the transport belt in the sequence: M-C-Y-K, as shown in FIG. 11, along the belt transport direction.

In the tandem type color image forming device according to the related art, the photoconductor drums of the respective color components are arranged in the sequence of M-C-Y-K in the direction from the upstream to the downstream of the transport belt, and the marks of the respective colors are assigned to the image formation areas of the respective colors arranged in a sequence that is the same as the sequence of the photoconductor drums in the above-mentioned arrangement.

FIG. 12 shows the arrangement of the image formation areas on the transport belt to which the toner marks of the respective colors are assigned according to art related to the invention. As shown in FIG. 12, the uppermost position in the mark sequence upstream of the belt transport direction is set to M. The area "a" (where "a" denotes the length of the mark in the belt transport direction) is assigned for each of the respective colors along the sequence of M-C-Y-K, respectively, and the mark of each color is formed therein. And the mark sequence in the belt transport direction is constituted in this manner.

Similarly, with respect to the optical-density detection mark (patch), the area "a" is assigned for each of the respective colors.

FIG. 13 is a timing chart for explaining the image formation area signals which cause the toner marks of the respective colors to be formed in the assigned image formation areas.

With respect to each of the image formation area signals of FIG. 13, the Low period is the write-enable period in which image formation is possible, and the shaded rectangular signal portion is the period (assigned for image formation) in which the toner mark of the color concerned is formed on the transport belt.

In FIG. 13, it is assumed that sub-scanning (belt transport) is performed at a constant speed and the period in the timing chart is considered a linear distance (length). And the image formation area length (or the write-enable period) is represented by "4*a*" (mm), and one fourth "a" (mm) of the image formation area length is assigned for each of the respective colors M, C, Y and K, as the shaded rectangular signal portion.

The pitch between two adjacent ones of the photoconductors of the respective colors is set to "b" (mm), and the timing of each image formation area signal is adjusted so that the toner marks of the respective colors are respectively formed in the assigned image formation areas on the transport belt.

As shown in FIG. 13, according to the related art, upon start of the mark formation, the photoconductor of M arranged in the uppermost position upstream of the belt transport direction is set in the write-enable period in which image formation is possible, and the mark of M is formed in the head-end image formation area on the transport belt.

Subsequently, the period of the photoconductor pitch "b" is delayed from the start, the photoconductor of C arranged in the second uppermost position upstream of the belt transport direction is set in the write-enable period in which image formation is possible, and the mark of C is formed in the second image formation area on the transport belt. Similarly, the mark of Y is formed in the third image formation area on the transport belt.

Subsequently, the period "3*b*" is delayed from the start, and the final mark of K is formed in the last image formation area on the transport belt.

Therefore, according to the related art, the total period "4*a*+3*b*" is needed from the start of formation of the first mark of M to the end of formation of the last mark of K.

The correction mode is automatically performed if a print request is received from the operation panel by the user and a change of the image formation operating state of the image forming device which degrades the image quality, such as a color deviation, takes place. For example, such a change may take place when printing documents more than a predetermined number of sheets is performed, or the image forming device starts operation from the idle state, such as power supply ON, or a temperature change arises which causes the operating state of the device, such as the exposure scanning unit, to change.

The above problem will become the hindrance of quick document printing, and the user who desires to obtain printed documents as early as possible will feel dissatisfaction, and the productivity will be reduced.

Therefore, in order to meet the demand for a quick image formation processing and suppress the fall of productivity, it is desirable to shorten the time needed for forming the toner marks.

SUMMARY OF THE INVENTION

According to one aspect of the invention, there is provided an improved color image forming device in which the above-described problems are eliminated.

According to one aspect of the invention there is provided a tandem type color image forming device which minimizes the time needed for forming the toner marks in the toner mark formation processing in the correction mode, thereby making the fall of productivity as small as possible.

In an embodiment of the invention which solves or reduces one or more of the above-mentioned problems, there is provided a color image forming device comprising: a plurality of first image support mediums of respective color components each adapted to support a color component image on a photoconductor surface respectively; a scanning exposure unit adapted to output a scanning light beam, generated in accordance with a line image signal of a main scanning direction, to each of the photoconductor surfaces of the color components of the first image support mediums at a predetermined cycle while the photoconductor surfaces are moved in a sub-scanning direction perpendicular to the main scanning direction, so that a two-dimensional color-component image is formed on each photoconductor surface by exposure to the scanning beam light; a second image support medium adapted to receive the color component images transferred from the first image support mediums of the respective color components to support a color composite image produced by the received color component images; a second image support medium transport unit transporting the second image support medium through image transfer positions of the respective color components in synchronization with movement of the first image support mediums of the respective color components in the sub-scanning direction; a transfer unit transferring the color component images from the first image support mediums of the color components to the second image support medium; a correction-pattern-image forming unit controlling the scanning exposure unit to form correction pattern images, each adapted for correcting the image formation operating states for the color component concerned, in predetermined areas arrayed on the second image support medium in the sub-scanning direction; a pattern measurement unit measuring the correction pattern images formed on the second image support medium by the correction-pattern-image forming unit; and a control unit correcting the image formation operating states for the respective color components in accordance with a result of the measurement of the pattern measurement unit to control image formation operation of the color image forming device, wherein the correction-pattern-image forming unit is configured to form one of the correction pattern images of the color components, which are formed in upper positions on the second image support medium upstream of a transport direction of the second image support medium by the scanning exposure unit, in a lowermost downstream one of the predetermined areas in the sub-scanning direction.

The above-mentioned color image forming device may be configured so that the correction-pattern-image forming unit is configured to start processing of forming the correction pattern images on the second image support medium immediately when one of the color component images corresponding to the correction pattern images is formed on a corresponding one of the first image support mediums at an earliest timing among the color component images.

The above-mentioned color image forming device may be configured so that the correction-pattern-image forming unit is configured so that a sequence of the color components of the correction pattern images formed by the correction-pattern-image forming unit in the sub-scanning direction is a reversal of a sequence of the color components of the color component images formed by the scanning exposure unit in the sub-scanning direction.

The above-mentioned color image forming device may be configured so that, when a length a of each of the correction pattern images is larger than a pitch b between two adjacent ones of the plurality of first image support mediums, processing of forming the correction pattern images for each of the color components is started earlier than in a normal printing mode by a time equivalent to $b(n-1)$ where n is the number of the color components.

The above-mentioned color image forming device may be configured so that, when a length a of each of the correction pattern images is smaller than a pitch b between two adjacent ones of the plurality of first image support mediums, processing of forming the correction pattern images for each of the color components is started earlier than in a normal printing mode by a time equivalent to $a(n-1)$ where n is the number of the color components.

The above-mentioned color image forming device may be configured so that the correction-pattern-image forming unit is configured to terminate processing of forming the correction pattern images immediately when a final one of the correction pattern images is formed on the second image support medium.

The above-mentioned color image forming device may be configured so that the correction pattern images are used for correction of image formation process conditions.

The above-mentioned color image forming device may be configured so that the correction pattern images are used for correction of color matching conditions of each color component.

The above-mentioned color image forming device may be configured so that the correction pattern images are used for correction of drive phase conditions of the first image support medium of each color component.

According to embodiments of the image forming device of the invention, at the time of performing the correction mode for optimizing the image formation operating states by using the correction pattern images (including the deviation detection toner marks and the optical density detection toner marks), the time needed for forming the correction pattern images can be shortened more, and the fall of productivity can be made as small as possible.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

In the following embodiments, the invention is applied to a tandem type color image forming device using the electrophotographic process which performs LD (laser diode) light writing of a two-dimensional image on a photoconductor in the main scanning direction and the sub-scanning direction.

In a typical tandem-type color image forming device, the photoconductors of respective colors are arranged at a constant pitch in the transport direction of the transport belt of a copy sheet. When the color component images from the photoconductors of the respective colors are transferred to the copy sheet transported with the transport belt, so that a color composite image is formed on the copy sheet.

However, the invention is not limited to the direct transfer system, and it is also applicable to the system in which the images from the photoconductors of the respective colors are transferred to the copy sheet through an intermediate transfer medium.

Figure 1:
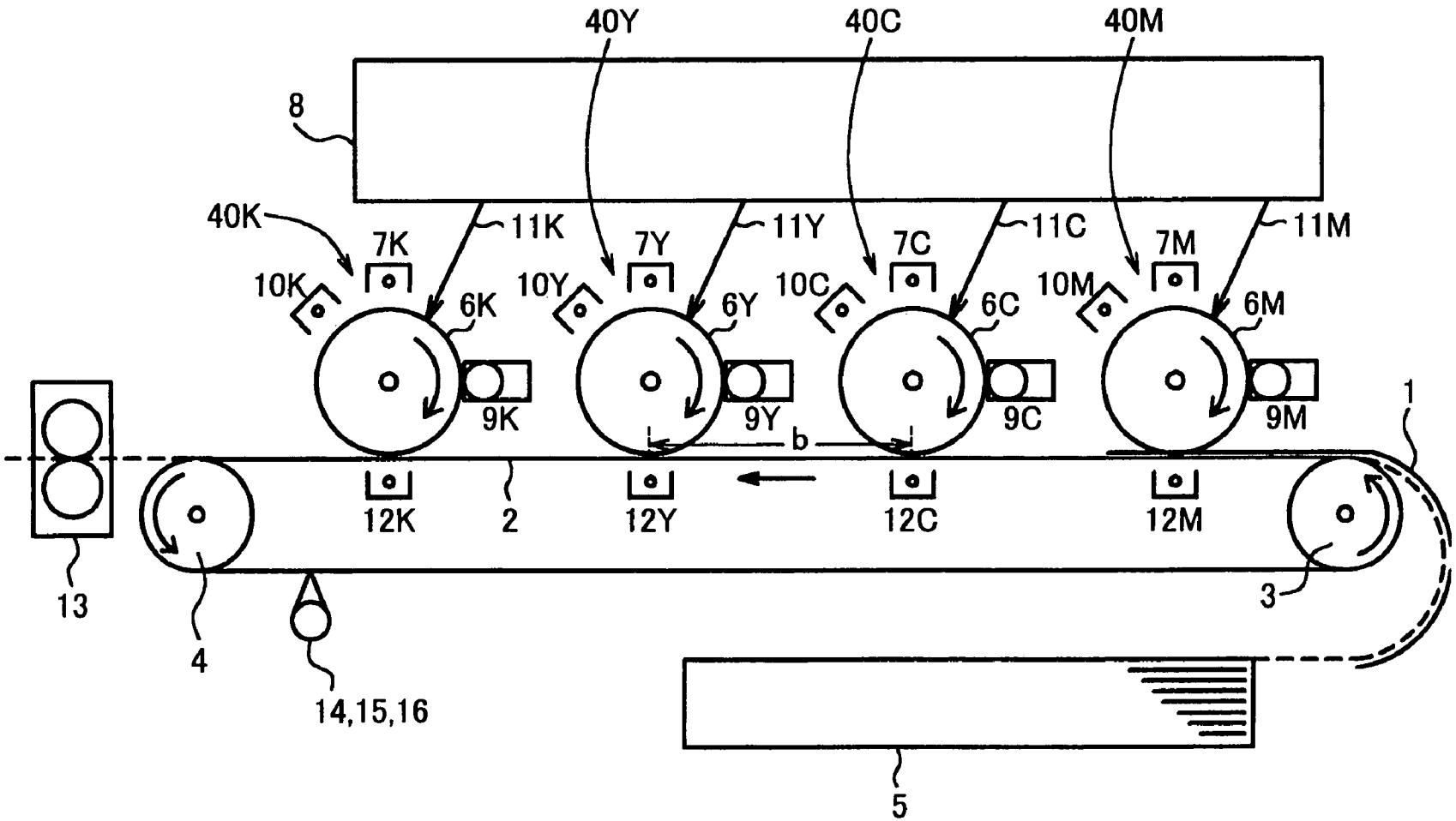
FIG. 1 is a diagram showing the composition of a color image forming device in an embodiment of the invention.

FIG. 1 shows the composition of a color image forming device in an embodiment of the invention.

As shown in FIG. 1, image formation parts 40M, 40C, 40Y and 40K which form images of the respective color components (magenta: M, cyan: C, yellow: Y, black: K) which constitute a color image are arranged sequentially from the upstream side in one row along the transport direction of a transport belt 2 which transports a copy sheet 1.

The transport belt 2 is an endless belt which is wound between a driven roller 4 which performs follower rotation and a driving roller 3 which performs drive rotation. The transport belt 2 is rotated by the driving roller 3 in the direction indicated by the arrow in FIG. 1.

There is provided in the lower part of the transport belt 2 a paper feed tray 5 in which copy sheets 1 are contained. The copy sheet 1 which is in the top position among the copy sheets 1 contained in the paper feed tray 5 is supplied at the time of image formation, and it is sucked by the transport belt 2 through electrostatic suction.

The copy sheet 1 is transported to the first image formation part (magenta) 40M by the transport belt 2, and image formation of magenta is performed therein.

The first image formation part (magenta) comprises a photoconductor drum 6M, and a charging unit 7M, an exposure unit 8, a development unit 9M, and a photoconductor cleaner 10M which are arranged around the periphery of the photoconductor drum 6M. Since the image formation parts 40C, 40Y and 40K of the other colors have the same component parts as those of the image formation part 40M (magenta) but only the toner images being formed are in different colors, a description thereof will be omitted.

After the surface of the photoconductor drum 6M is uniformly charged by the charging unit 7M, it is exposed to the laser beam 11M corresponding to the image of magenta emitted by the exposure unit 8, so that an electrostatic latent image is formed on the photoconductor surface.

In the exposure unit 8, the laser light is emitted to the photoconductor surface as a scanning light at a predetermined cycle by controlling the light intensity of a LD light source (not shown) in accordance with a line image signal of the main scanning direction. At the same time, the photoconductor drum 6M is moved (or rotated) in the sub-scanning direction which is perpendicular to the main scanning direction so that a scanning exposure of a two-dimensional image is performed by the scanning beam. The control of the sub-scanning is carried out based on the control of the motor which rotates the photoconductor drum 6M.

The electrostatic latent image formed on the photoconductor surface is developed with toner by the development unit 9M, so that a toner image is formed on the photoconductor drum 6M. This toner image is transferred to the copy sheet carried on the transport belt 2 by the transfer unit 12M at the position (transfer position) where the transport belt 2 is in contact with the photoconductor drum 6M, so that a monochrome (magenta) image is formed on the copy sheet 1.

The photoconductor drum 6M after the image transfer is completed is cleaned by the photoconductor cleaner 10M which removes the unnecessary toner remaining on the drum surface, and the photoconductor drum 6M is ready for a next image formation.

The copy sheet 1 to which the monochrome (magenta) image is transferred by the first image formation part (magenta) 40M is transported to the second image formation part (cyan) 40C by the transport belt 2. Similar to the first image formation part (magenta) 40M, the toner image (cyan) formed on the photoconductor drum 6C is transferred to the copy sheet 1 in a superimposed manner.

The copy sheet 1 is further transported to the third image formation part (yellow) 40Y and to the fourth image formation part (black) 40K, the formed toner images are similarly transferred to the copy sheet 1, so that a color composite image is formed on the copy sheet 1.

The copy sheet 1 which is passed through the fourth image formation part 40K and carries a color image formed thereon is separated from the transport belt 2 and subjected to the image fixing by the fixing unit 13. The copy sheet is ejected to the outside of the color image forming device.

The color image forming device of this embodiment is provided with a correction unit which carries out the correction mode using the toner mark detection process, in order to optimize the color image formation operating state and to obtain a high-quality color image.

In this embodiment, the image formation parts 40M, 40C, 40Y and 40K of the respective colors are operated, and the deviation detection toner marks and the optical density detection toner marks are formed on the transport belt 2. A change of each of the toner marks is measured based on a change of the characteristic of the image formation parts 40M, 40C, 40Y and 40K of the respective colors, and the image forming device operating state is monitored.

In order to detect the toner marks on the transport belt 2, the toner mark detection sensors 14, 15 and 16 are provided, and a positional deviation and an optical density deviation are detected by using the following detection method.

Positional Deviation Detection

In the composition of FIG. 1, the image formation parts 40M, 40C, 40Y and 40K of the respective colors are arranged in one row with the constant pitch "b" in the transport direction of the transport belt. Therefore, in order to superimpose the respective images of the color components formed on the photoconductors, it is necessary to adjust the image writing timing to each photoconductor so that the images of the respective color components may have consistency at the transfer positions on the transport belt 2 which are separated from each other by the pitch "b".

However, even if the adjustment is performed once, a deviation may arise again due to a variation with time. At the timing in which a change of the operating state is expected, the operating state is detected, and the operating state is corrected in accordance with the result of the detection. For example, such a change may arise when printing documents more than a predetermined number of sheets is performed, or the image forming device starts operation from the idle state, such as power supply ON, or a temperature change arises which causes the operating state of the device, such as the exposure scanning unit, to change.

The positional deviation produced between the images of the respective colors is corrected by adjusting the sub-scanning registration, the inclination (skew), the main-scanning registration, and the scanning magnification, respectively. The measurement of the toner marks is carried out in order to obtain the correction amounts therefor.

Figure 2:
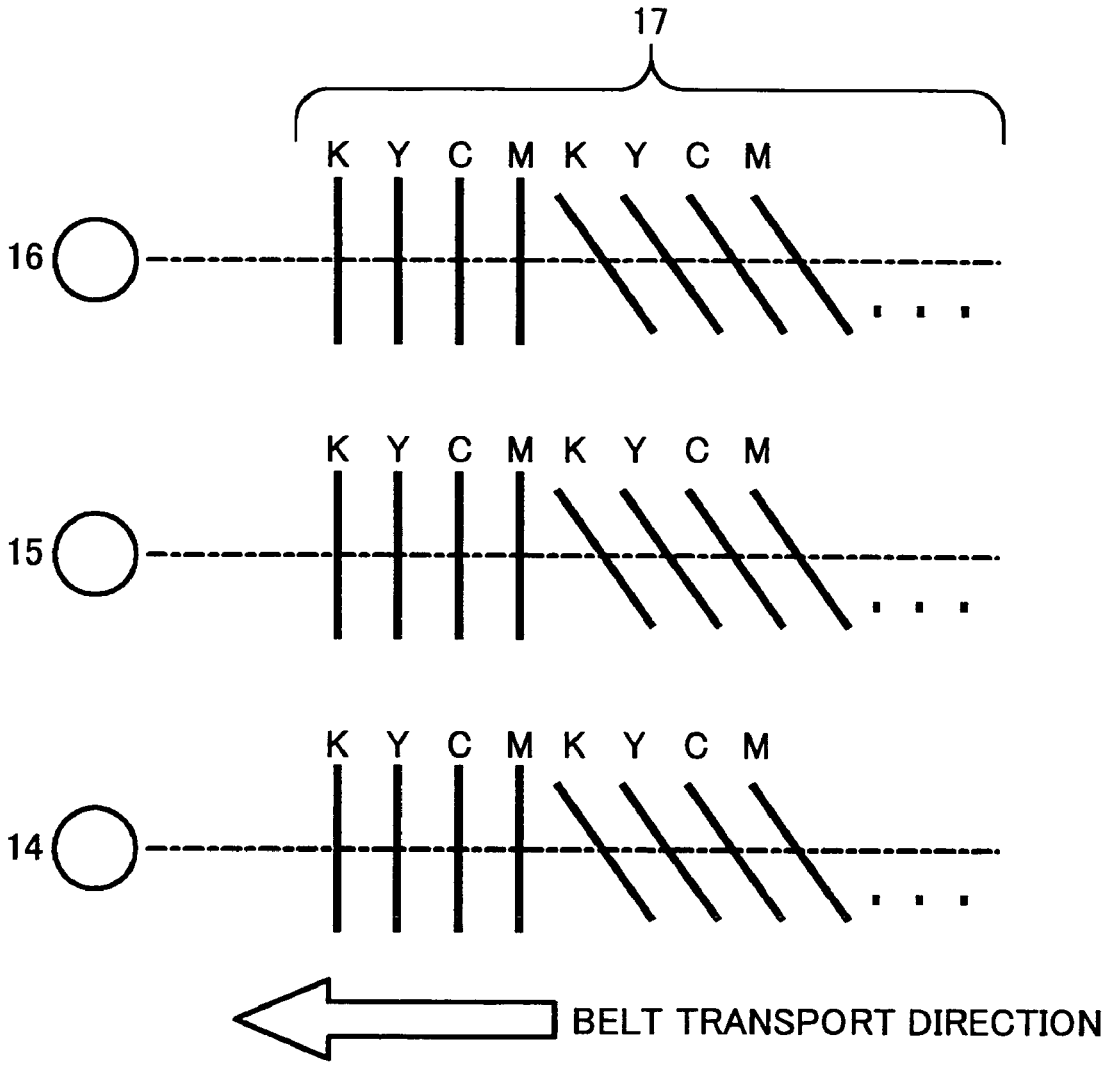
FIG. 2 is a diagram for explaining the arrangement of toner marks for detection of positional deviation between respective colors in an embodiment of the invention.

FIG. 2 shows the arrangement of the sequence of the deviation detection toner marks 17 formed on the transport belt 2 in an embodiment of the invention. As shown in FIG. 2, the mark sequence 17 which includes four lateral lines and four slanting lines of the respective colors arranged at predetermined intervals is set up as one group, and this mark sequence 17 is formed at each of the detection positions of the toner mark detection sensors (which are called sensors) 14, 15 and 16 arranged on the transport 2 at three different positions in the main scanning direction. Namely, at each of the detection positions of the sensors 14, 15 and 16, the toner mark sequence 17 including the set of eight marks is formed, respectively.

The reason for forming the toner mark sequence 17 including the set of eight marks is to raise the detection accuracy by matching with the position change phase due to a change of the driving speed of the transport belt running in the sub-scanning direction, forming the toner marks in consideration of the phase so that the error in the case of pattern formation and detection may be made as small as possible as shown in FIG. 2, and computing the average of these detection results.

The measurement of a skew to the reference color (which is usually K), the sub-scanning registration deviation, the main-scanning registration deviation, and the scanning magnification error is possible by detecting the lateral lines and slanting lines of K, Y, C and M (the set of eight marks) and by using the sensors 14, 15 and 16. The image is shifted in the direction opposite to the deviation direction by one half of the maximum amount of deviation detected by the respective sensors, which makes it possible to correct the deviation so that the amount of deviation due to the magnification error in the main scanning direction may not be conspicuous.

The method of computing the correction amount may be performed by using the known method (for example, see Japanese Laid-Open Patent Application No. 2004-101567), and a description thereof will be omitted.

Optical Density Detection

An example in which the sensors used for the deviation detection toner mark sequence 17 are used also for optical density detection will be explained.

In the composition of FIG. 1, toner is supplied from the toner cartridge (not shown) to the development units 9M, 9C, 9Y and 9K of the respective colors, respectively. Generally, the toner thus supplied is transported in one direction from the device back side to the front side, for example (which direction matches with the main scanning line).

Thus, for a certain time after the toner supply, the toner may be in a state where the density of the toner on the device back side is high and the density of the toner on the device front side is low.

If the process control (or electrophotographic process control) is performed on the back side while the toner is in such a state, namely the sensor on the back side of the main scanning line performs optical density detection, then the result of detection of the optical density of an image will be comparatively low as a whole.

On the contrary, if the process control is performed using the sensor on the front side of the mian scanning line while the toner is in such a state, then the result of detection of the optical density of an image will be comparatively high as a whole. Thus, it is difficult to detect a correct optical density of the image.

In order to form a toner patch (mark) sequence used for detection in the process control, the sensor 15 arranged in the center in the main scanning direction among the sensors 14, 15 and 16 in this example is used for detection shared to the process control. This is because the toner near the center on the main scanning line has a desired in-between density.

Figure 3:
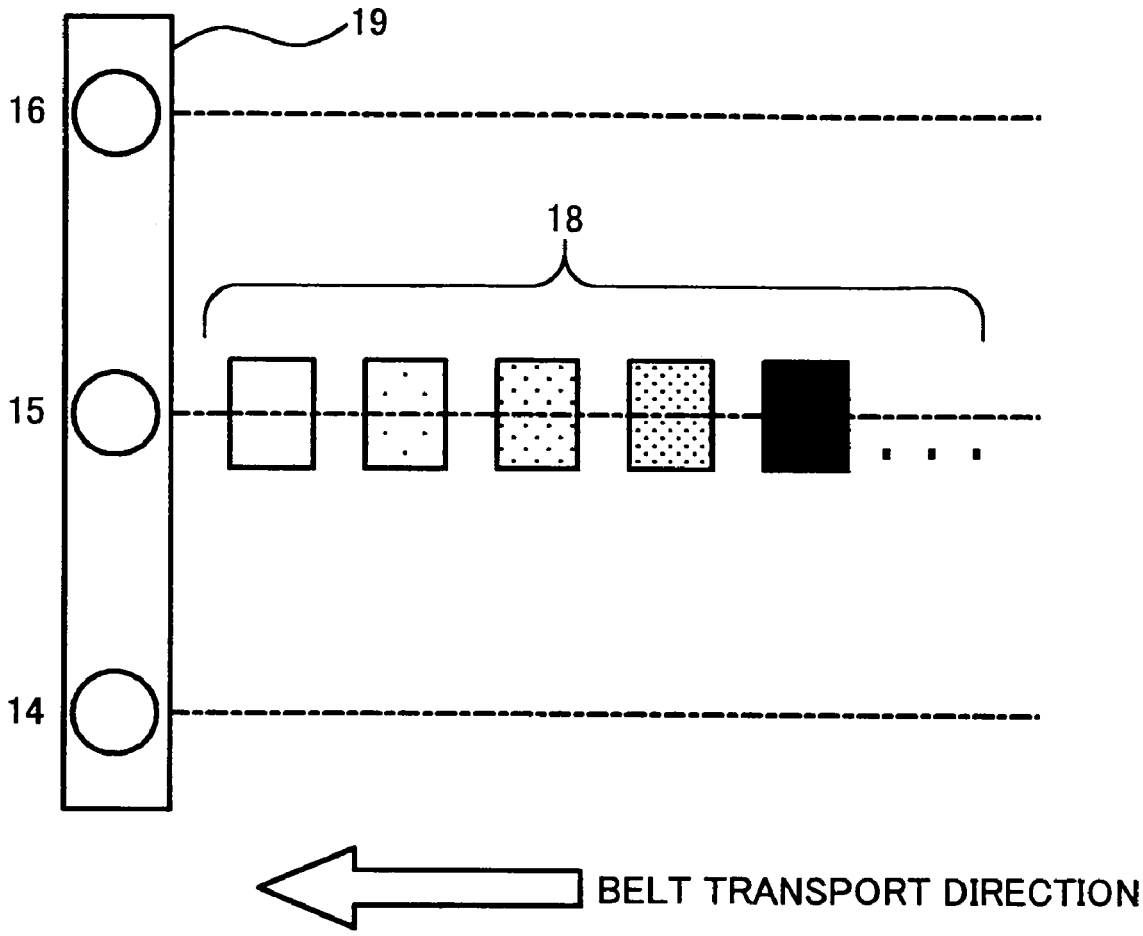
FIG. 3 is a diagram for explaining the arrangement of optical density detection toner marks in an embodiment of the invention.

FIG. 3 shows a toner patch sequence 18 for use in the process control which is formed on the transport belt 2 (only the toner patch sequence of K is shown in FIG. 3).

As the toner patch sequence 18, two or more marks with different gradations of each of the color components K, C, M and Y are formed on the transport belt 2 only at locations under the sensor 15. By detecting it using the sensor 15, the setting of a development bias, a charging bias, a laser exposure power, etc. can be performed in the process control, and the optical density of an image can be controlled optimally.

The sensors 14, 15 and 16 are mounted on the same chip 19 as shown in FIG. 3. With the arrangement of the plural sensors mounted on the same chip, management of the parts and the chip becomes easy and reduction of the cost can be attained.

The optical density detection toner mark sequence of this example is also applicable to an image forming device which is provided to form a pattern for color matching control, a pattern for photoconductor drive phase control, etc. other than the toner patch for process control mentioned above.

The correction function that performs the correction mode operation is provided in the control system of the color image forming device. In the correction mode, this function is to form the above-mentioned toner mark (patch) sequences for both deviation detection and optical density detection on the transport belt 2, measure the formed toner mark (patch) sequences by using the sensors 14, 15 and 16, and perform the correction for optimizing the image formation operating states according to the result of measurement.

Figure 4:
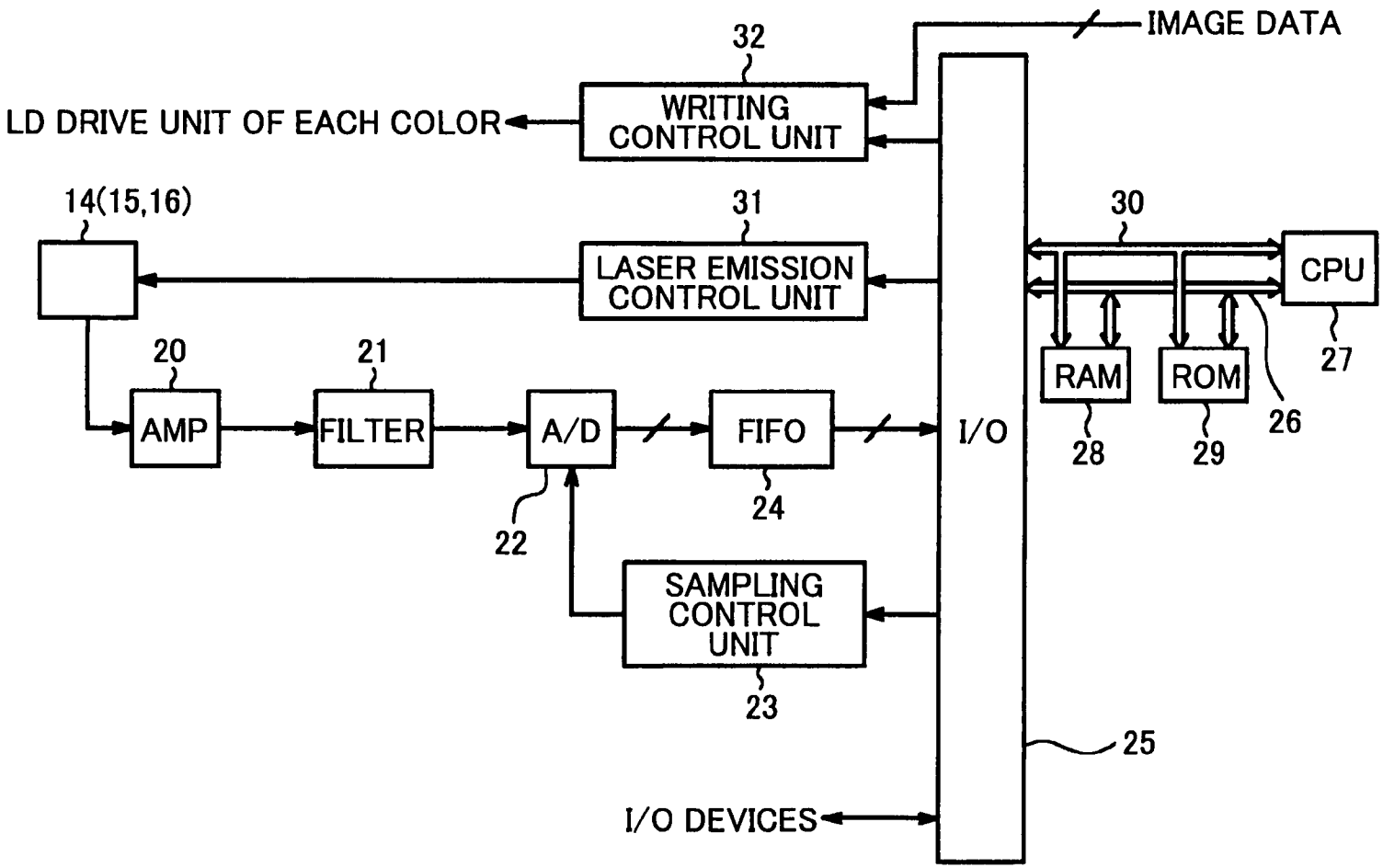
FIG. 4 is a block diagram showing the composition of a control system of the color image forming device in an embodiment of the invention.

FIG. 4 shows the composition of a control system of the color image forming device in an embodiment of the invention.

In the composition of FIG. 4, the CPU (central processing unit) 27, the RAM (random access memory) 28 and the ROM (read-only memory) 29, function as a system control unit which controls the whole image forming device. To realize this function, the CPU 27 carries out the control actions for controlling respective component parts including various I/O devices (I/O devices), by using various kinds of control programs and data for the control programs, stored in the RAM 28 or the ROM 29 if needed. Among them, the control action in the correction mode according to the toner mark detection system is included. The control action in the correction mode includes starting operation of the correction mode at a predetermined execution timing, and performing operation and processing of the data required for carrying out a series of correction operations including formation of the toner marks, measurement of the toner marks, and adjustment of the setting values according to the result of the measurement.

As hardware composition of the control system, the CPU 27 is provided with the data bus 26 and the address bus 30 for exchanging the data, such as the image data being processed and the control data, between the RAM 28 and the ROM 29 and between the various I/O devices via the I/O port 25.

The writing control unit 32, the laser emission control unit 31, the FIFO (first-in first-out) 24, and the sampling control unit 23 are contained in a part of the various I/O devices.

The writing control unit 32 is a chip which controls the LD driving plate which drives the LD (laser diode) for exposure which performs the optical writing of images of the respective color components. In this chip, the circuit for executing operation of the normal printing mode and the circuit for executing the correction mode, different from the normal printing mode, which forms the toner marks are provided.

The sensors 14, 15 and 16 are of the type having a light emission part used for detection of toner marks. The laser emission control unit 31 is a device which controls the emission light intensity of each of the light emission parts of the sensors 14, 15 and 16.

The FIFO 24 and the sampling control unit 23 are devices which are used for acquiring detection data from the sensors 14, 15 and 16.

The outline of the correction operation which is performed by the CPU 27 of the control system of FIG. 4 in accordance with the instruction codes to the CPU 27 will be explained as follows. The toner mark signal detected by the sensor 14 (15, 16) is amplified by the amplifier (AMP) 20. The frequency components exceeding the desired frequency are cut off from the amplified toner mark signal by using the filter 21.

Subsequently, the detection signal which is the analog signal output from the filter 21 is converted into digital data by the A-D converter 22. The sampling of data in the A-D converter 22 is controlled by the sampling control unit 23. In this example, the sampling frequency is 100 kHz. The sampled data is stored in the FIFO memory 24 one by one.

The composition and operation of the control system with only the sensor 14 has been discussed. As for the other sensors 15 and 16, the same composition and operation can be applied, and a description thereof will be omitted.

After the detection of toner marks is completed, the stored data are transferred via the I/O port 25 to the data bus 26 and further transferred to the CPU 27 and the RAM 28 via the data bus 26. In accordance with the control program stored in the ROM 29, various amounts of deviations, such as deviations of the toner marks and optical density differences, are calculated, and operation processing for determining the correction amount which optimizes the image formation operating states is performed.

Based on the correction amount calculated from the measurement result of the positioning toner marks, the CPU 27 performs the setting of the writing control unit 32 in order to change the image writing frequency based on the change of the sub-scanning/main-scanning registration, the correction of the skew, and a magnification error.

The writing control unit 32 includes components parts adapted to set up the output frequency in a very fine amount (for example, a clock generator using a voltage-controlled oscillator (VCO)), for the respective colors including the standard color.

By using the VCO output having the frequency according to the setting of correction operation as the image clock, the process control, the color matching control, and the photoconductor drive phase control are performed, so that an optimized image output can be obtained.

The CPU 27 monitors the detection signal output from the sensor 14 (15, 16) at a suitable timing. The monitored detection signal is used in order to control the emission light intensity by the laser emission control unit 31, so that a corrected emission light intensity which can perform detection of the toner marks certainly even if degradation of the light emission part of the sensor 14 (15, 16) or the transport belt 2 takes place. Namely, the level of the emission light intensity from the light emission part is always maintained at a constant level.

Next, a description will be given of the formation of the toner marks used in order to correct the image formation operating states in an embodiment of the invention.

As described above, in order to measure the operating state of the image formation parts at the time of correction, the image formation parts 40M, 40C, 40Y and 40K of the respective color components are actually operated on the current setting conditions, and the toner marks are formed on the transport (transfer) belt 2 (see FIG. 2 and FIG. 3).

The toner marks on the transport belt 2 are detected by the sensors 14, 15 and 16. The toner marks of each color are formed according to predetermined conditions, so that the deviation (error) from the proper operating state can be obtained as the measuring result.

For example, in the case of the deviation detection toner marks, as shown in FIG. 2, the mark sequence including the four lateral lines and four slanting lines of the respective colors arranged at the predetermined intervals is set up, and the plural mark sequences are arranged on the transport belt at the detection positions where the sensors 14, 15 and 16 are provided directly above the detection positions in the main scanning direction.

Figure 11:
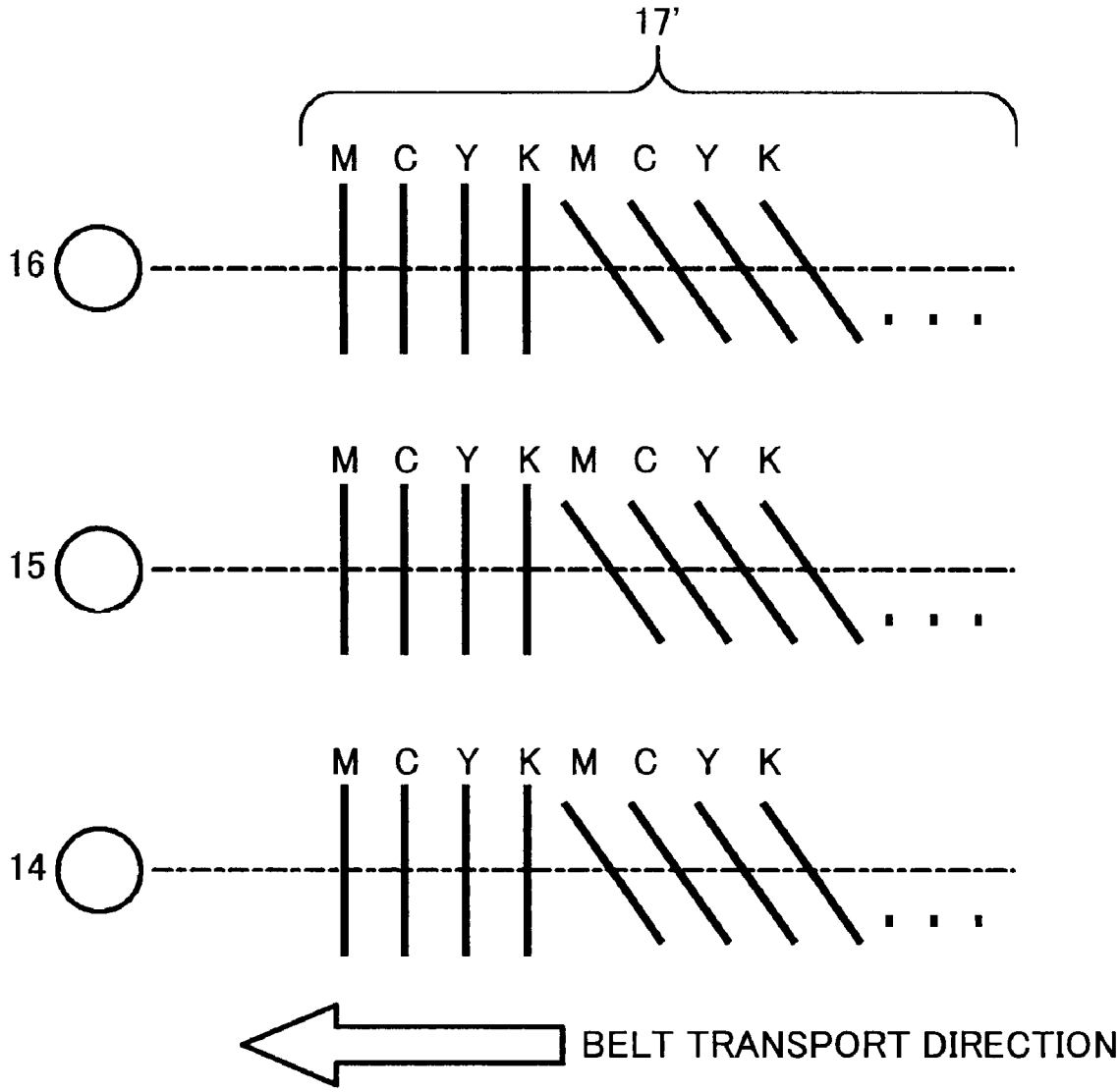
FIG.11 BACKGROUND ART
FIG. 11 is a diagram for explaining the arrangement of toner marks for detection of positional deviation between respective colors according to art related to the invention.
Figure 12:
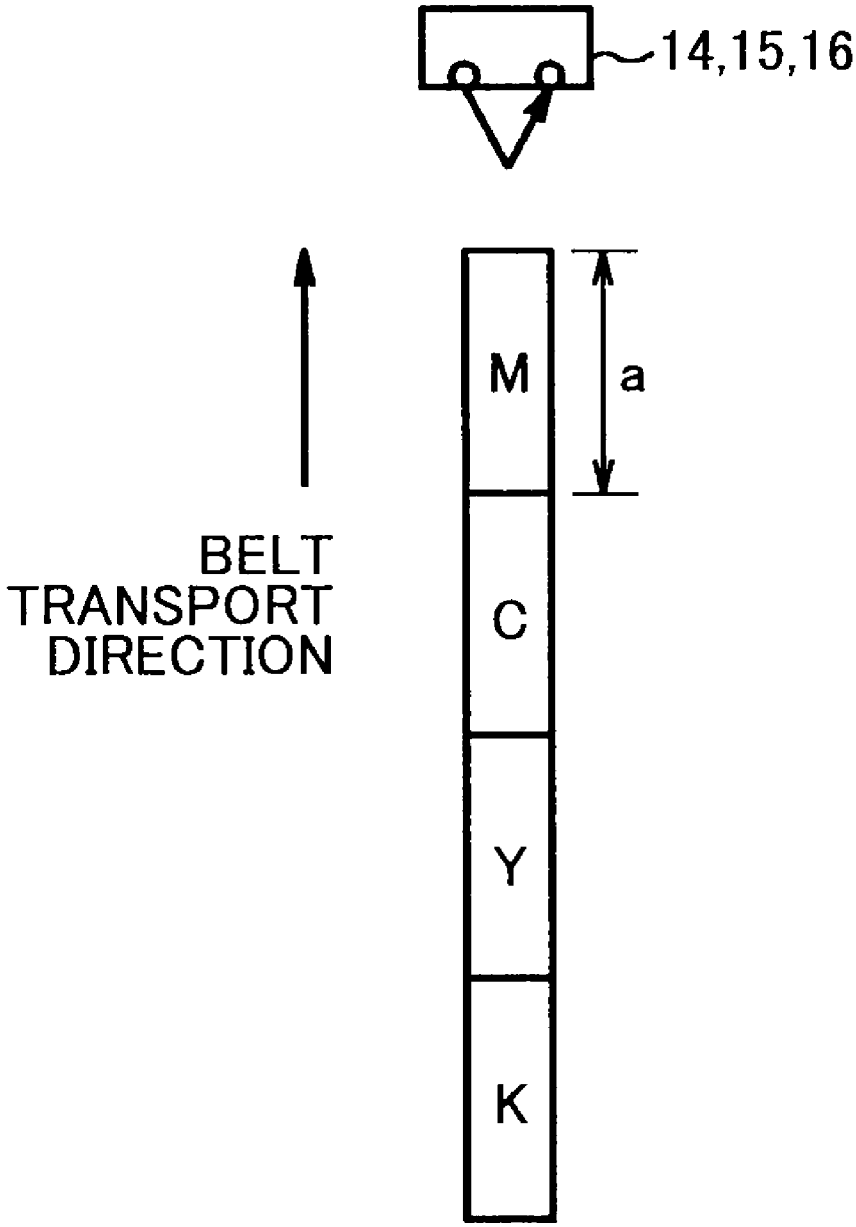
FIG.12 BACKGROUND ART
FIG. 12 is a diagram for explaining the arrangement of image formation areas on the transport belt to which the toner marks of the respective colors are assigned according to art related to the invention.

As previously described, the deviation detection toner marks according to the related art are formed on the transport belt the toner marks are formed on the transport belt in the sequence: M-C-Y-K, as shown in FIG. 11, along the belt transport direction.

Figure 13:
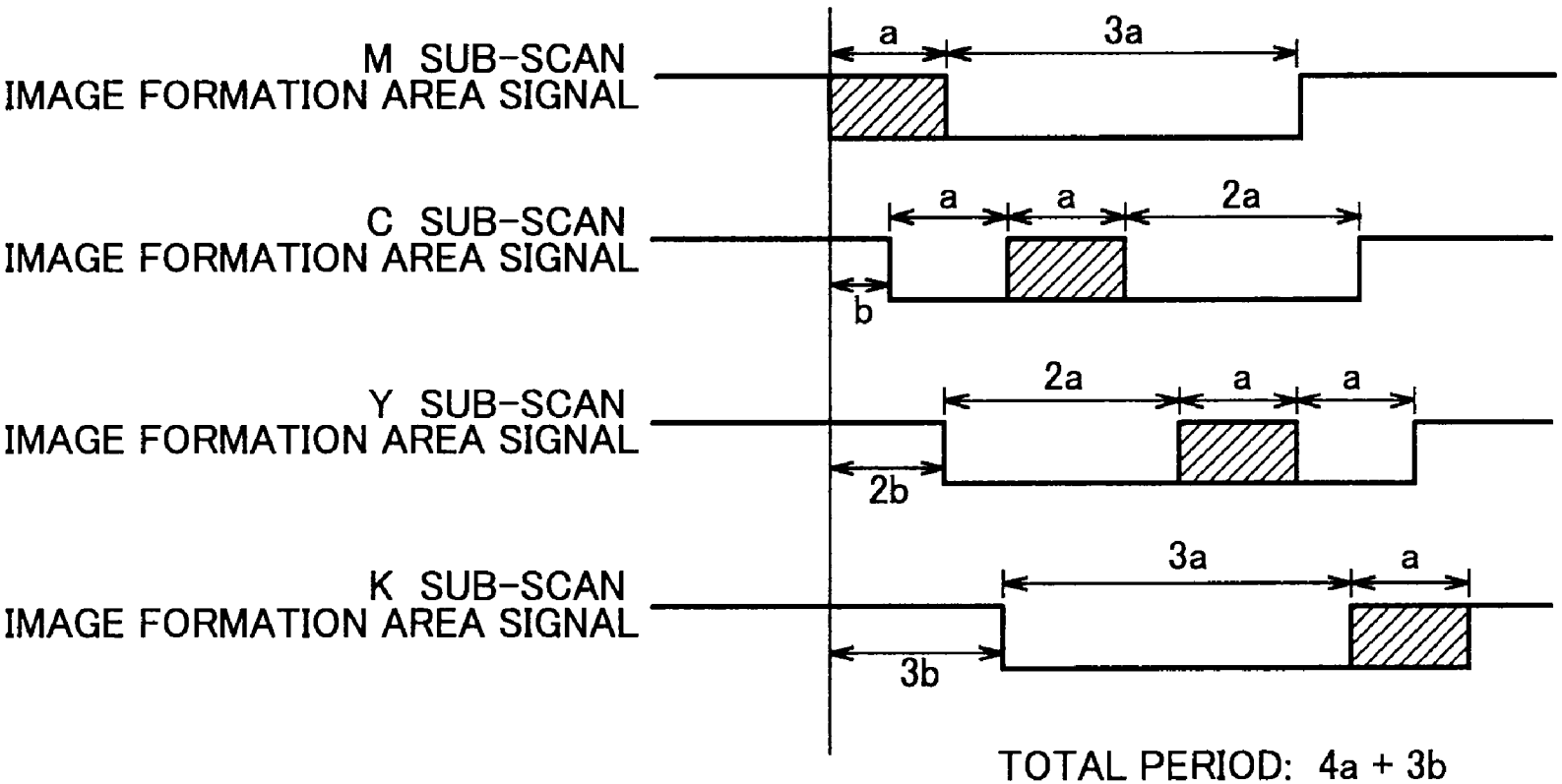
FIG.13 BACKGROUND ART
FIG. 13 is a timing chart for explaining the image formation area signals which cause the toner marks of the respective colors to be formed in the image formation areas of FIG. 12.

As shown in FIG. 13, according to the related art, upon start of the mark formation, the photoconductor of M arranged in the uppermost position upstream of the belt transport direction is set in the write-enable period in which image formation is possible, and the mark of M is formed in the head-end image formation area on the transport belt.

Subsequently, the period of the photoconductor pitch "b" is delayed from the start, the photoconductor of C arranged in the second uppermost position upstream of the belt transport direction is set in the write-enable period in which image formation is possible, and the mark of C is formed in the second image formation area on the transport belt. Similarly, the mark of Y is formed in the third image formation area on the transport belt.

Subsequently, the period "3*b*" is delayed from the start, and the final mark of K is formed in the last image formation area on the transport belt.

Therefore, according to the related art, the total period "4*a*+3*b*" is needed from the start of formation of the first mark of M to the end of formation of the last mark of K.

Correction of the image formation operating states by using the formation of the toner marks is indispensable in order to obtain a quality color image, but the toner mark formation method according to the related art becomes the hindrance of quick document printing, and causes the productivity to be reduced.

The color image forming device according to the invention aims at improvement of the related art technology in order to shorten the time required for forming the toner marks in the toner mark formation processing at the time of the correction mode.

One aspect of the present that is adopted in order to enable shortening of the time required for the mark formation is to make the sequence of the color components of the toner marks formed in the sub-scanning direction into a reversal of the sequence of the color components of the color component images transferred to the transport belt by the transfer units 12M, 12C, 12Y, 12K.

That is, the image formation part arranged in the lowermost downstream position on the transport belt 2, since the mark formation area was assigned in the belt transport direction in order of the row of M-C-Y-K from the upper stream, the time "4*a*+3*b*" required in order to assign the area of K) at the end (refer to FIG. 13), therefore to complete the mark of a total color by formation of K mark and to form a toner mark cannot be shortened according to the related art.

According to the color image forming device of the invention, shortening is made possible by assigning the last mark formation area to image formation parts other than the image formation part arranged at the upper stream side of transport belt 2 (this example C, Y, K), i.e., the image formation part arranged in the style of the lowest (in this example, K).

Figure 5:
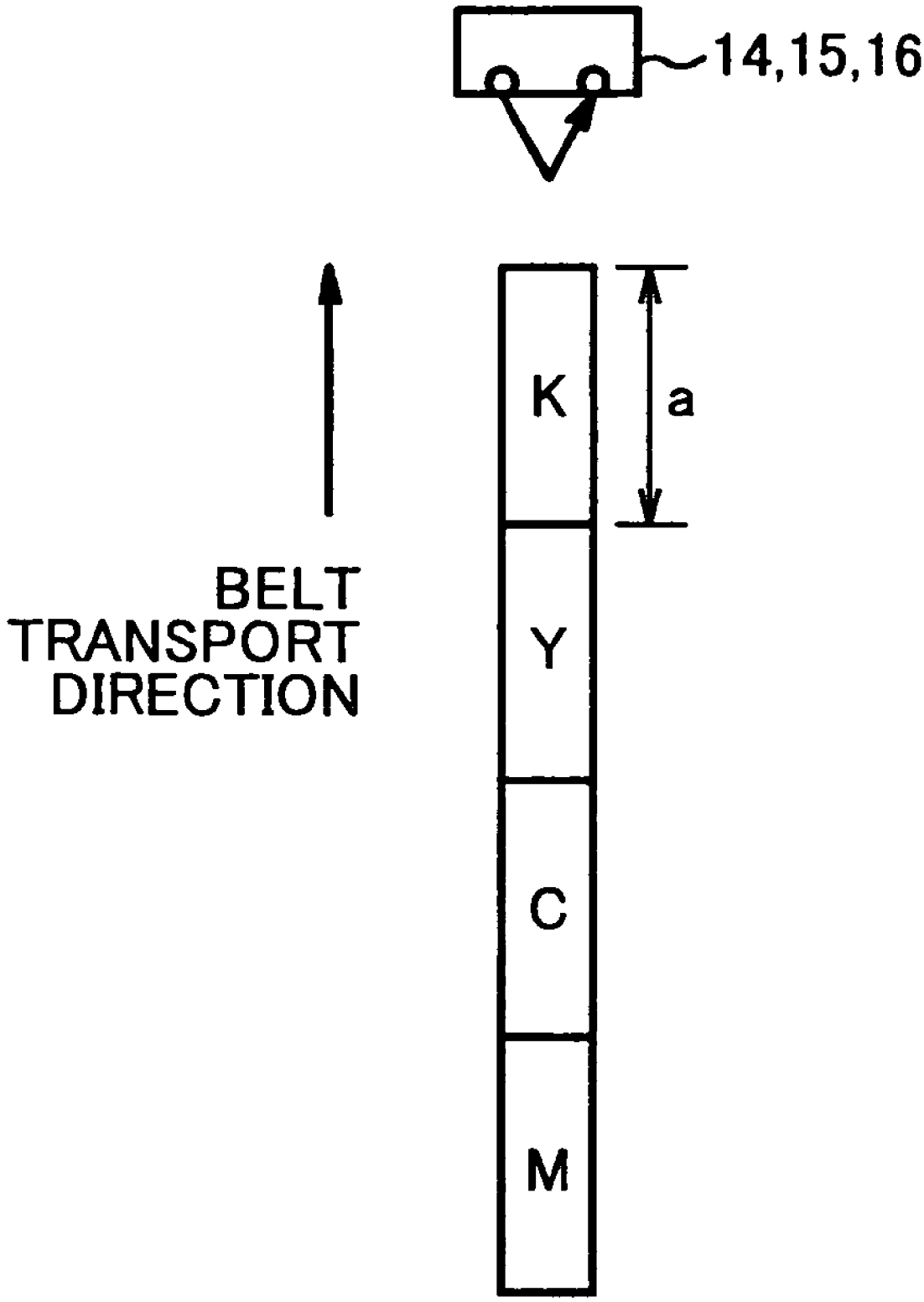
FIG. 5 is a diagram for explaining the arrangement of image formation areas on the transport belt to which the toner marks of the respective colors are assigned in an embodiment of the invention.

As an example which assigned the last mark formation area to the image formation part arranged at the upper stream side, the example made into the row of K-Y-C-M is conversely shown in FIG. 5 with the row (see FIG. 1) of image formation parts 40M, 40C, 40Y and 40K arranged in the belt transport direction.

As shown in FIG. 5, K which has arranged image formation part 40K downstream most is made into a head, area a is assigned to each color along K-Y-C-M in order, respectively, the mark of each color is formed there, and the mark sequence of the belt transport direction is constituted.

As for the optical density detection toner marks (patch), the area "a" is similarly assigned to each color, respectively.

Figure 6:
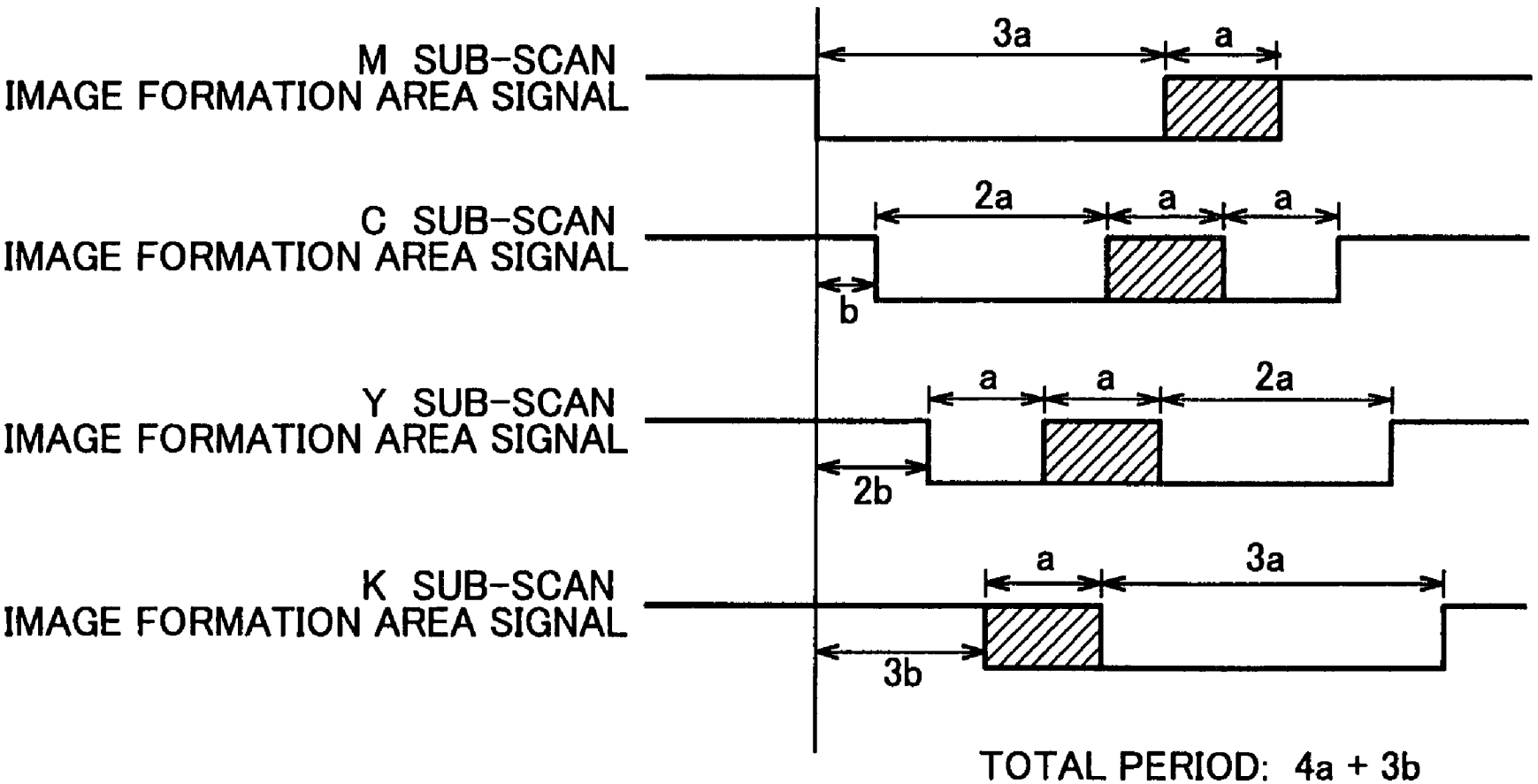
FIG. 6 is a timing chart of the image formation area signals which cause the toner marks of the respective colors to be formed in the image formation areas of FIG. 5.

FIG. 6 is a timing chart of the image formation area signals when assigning the toner marks of the respective colors to the mark formation areas shown in FIG. 5.

With respect to each of the image formation area signals in FIG. 6, the Low period is the write-enable period in which image formation is possible, and the shaded rectangular signal portion is the period (assigned for image formation) in which the toner mark of the color concerned is formed on the transport belt.

In FIG. 6, it is assumed that the sub-scanning (belt transport) is performed at a constant speed, and the period in the timing chart is considered a linear distance (length). And the image formation area length (or the write-enable period) is represented by "4*a*" (mm) and one fourth "a" (mm) of the image formation area length is assigned for each of the respective colors M, C, Y and K, as the shaded rectangular signal portion.

As shown in FIG. 6, upon start of mark formation operation, the image formation area signal of M, whose photoconductor is in the uppermost upstream position, is set to the write-enable period.

Subsequently, after the period of the photoconductor pitch "b" is delayed, any of the image formation area signals of C, Y and K, whose photoconductors are in the lower downstream positions, is set to the write-enable period sequentially one by one. The write-enable period of 4*a* for each color is secured, and the write-enable periods which are the same as those in the normal printing mode are secured.

As shown in FIG. 6, if mark formation is started, M which exists in the style of the transport belt 2, the top will write in, and an enable period will come, but since the last of this period is assigned as a writing area of a mark, in this example, the mark writing of M is performed last.

About C arranged after the transport direction of transport belt 2, the period of photoconductor pitch b is delayed and written in from a start, an enable period comes and the mark of C is written in the third area of this period.

Thus, it operates until it delays the period 3*b* from a start and writes the mark of K in the area of the head of a write-enable period one by one.

Therefore, after writing in M, considering it as an enable period and starting operation before ending the write-enable period of K, the total period "4*a*+3*b*" will be required.

However, before ending the write-enable period of K, all mark writing is completed. Therefore, the time "4*a*+3*b*" in the case of the related art can be shortened by ending the processing without waiting for the end of the write-enable period of K.

The following embodiment is adapted to deactivate the image writing of the respective colors at the end of mark formation operation when the sequence of the color components of the toner marks in the sub-scanning direction is a reversal of the sequence of the color components of the color component images transferred by the image formation parts in the sub-scanning direction, similar to the above-mentioned embodiment (FIG. 6), thereby shortening the time required.

Figure 7:
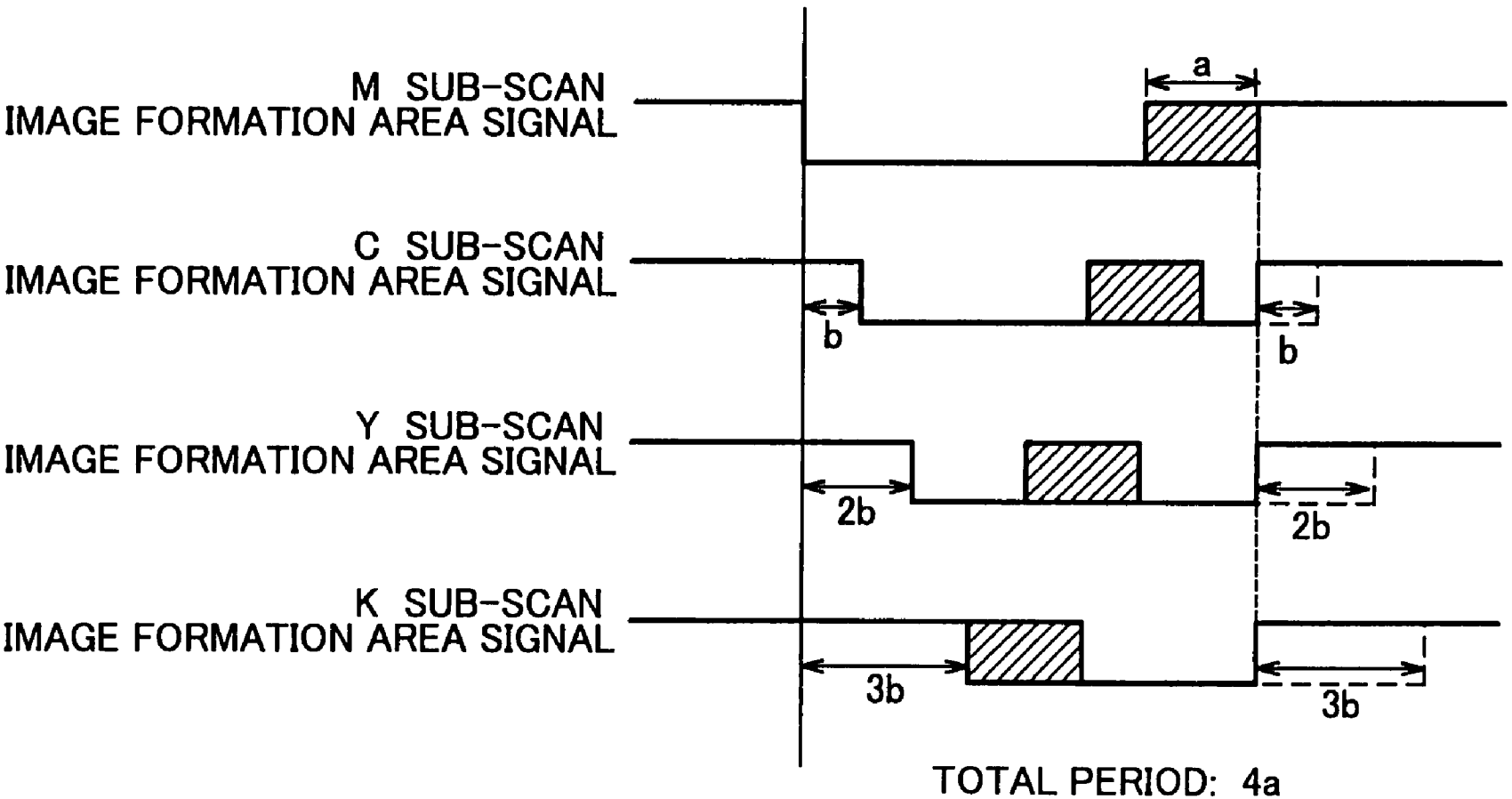
FIG. 7 is a timing chart of the image formation area signals for explaining mark formation operation ($a>b$) which deactivates the image writing of the respective colors.

FIG. 7 is a timing chart of the image formation area signals for explaining mark formation operation (a>b) which deactivates the image writing of the respective colors at the end of mark formation operation.

In the timing chart of FIG. 7, the M mark image is formed last (when a<b, however, the C or Y mark image is formed last).

In the timing chart of FIG. 7, when formation of the mark image of M is completed, formation of the mark images of all the color components is completed. Therefore, even if the write-enable period of other colors (C, M, Y) is not completed at this time, these write-enable signals are deactivated (the write-enable signal of C is deactivated for a time of b, the write-enable signal of Y is deactivated for a time of 2*b*, and the write-enable signal of K is deactivated for a time of 3*b*), and the mark formation processing is ended.

In the case of this embodiment, the time required is a period between the start of the write-enable period of M and the end of the write-enbale period of M, and this period is equivalent to "4*a*" as shown in FIG. 7. Thus, the time required can be shortened by a time equivalent to 3*b* when compared with the related art.

In the above-mentioned embodiment (FIG. 7), the case in which the sequence of the color components of the toner marks in the sub-scanning direction is a reversal of the sequence of the color components of the color component images transferred by the image formation parts in the sub-scanning direction is discussed. However, the present invention is not limited to this embodiment. For example, if one (C or Y) of the toner marks of the color components, which are formed in the upper positions on the transport belt upstream of the belt transport direction, is formed in the lowermost downstream one of the mark formation areas in the sub-scanning direction and the write-enable signal is deactivated immediately when the formation of the mark image of the last timing is completed, the time required can be shortened when compared with "4*a*+3*b*" in the case of the related art.

The following embodiment is adapted to eliminate the precondition for securing the write-enable periods which are the same as those of the normal printing mode as in the previously described embodiment (FIG. 6), thereby shortening the time required.

In the previous embodiment (FIG. 6), the write-enable period of 4*a* is secured for each of the color components M, C, Y and K, and the write-enable periods of M, C, Y and K are delayed each other by a time equivalent to the pitch b. This is the precondition for securing the write-enable periods which are the same as those of the normal printing mode.

When the last mark formation area is set by one of M, C and Y which are arranged in the upper positions upstream of the sub-scanning direction, the non-writing period in which writing operation of the mark image is not performed will be produced at the time of start of the mark formation operation of each color. Even if the non-writing period is deleted, the mark formation operation in the correction mode is not affected.

Therefore, shortening of the time required is attained by deleting the non-writing periods produced at the start of mark formation operation and bringing forward the time of start of mark formation operation of each color.

Figure 8:
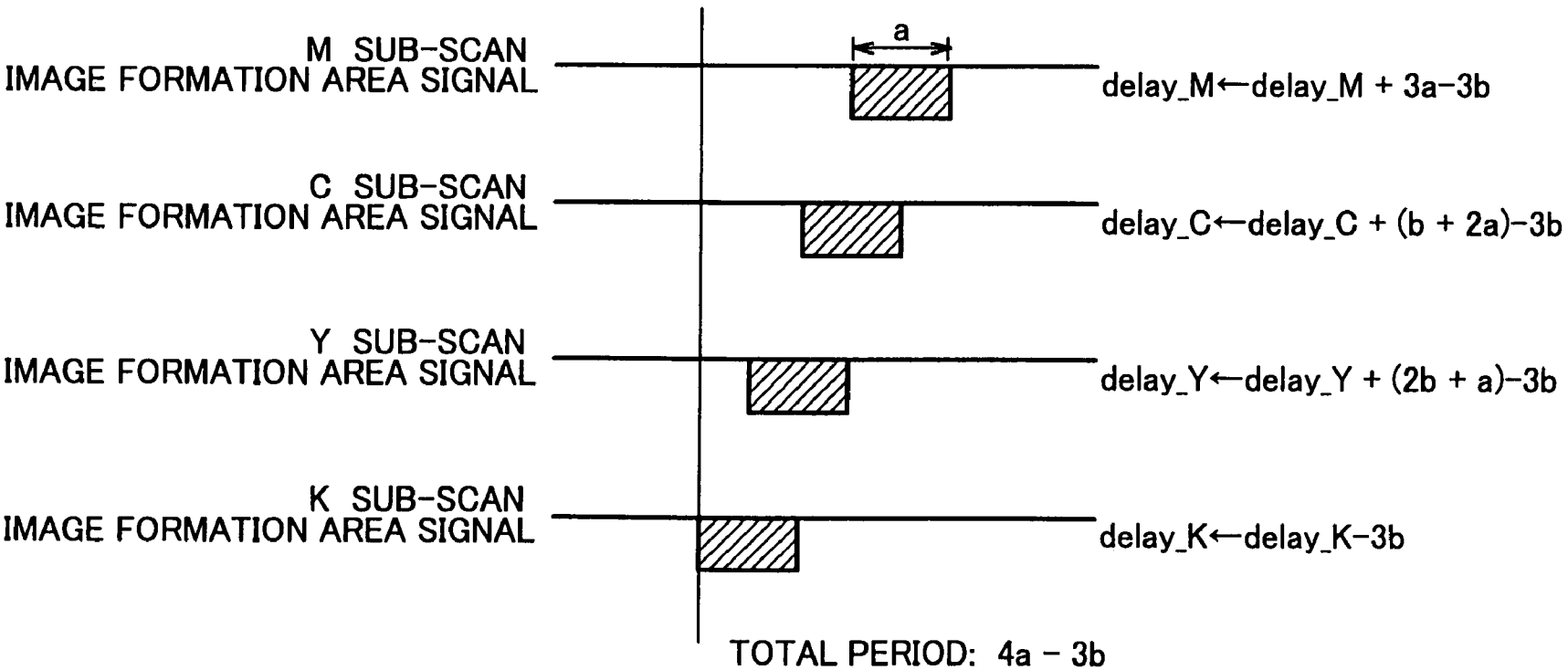
FIG. 8 is a timing chart of the image formation area signals in which the non-writing periods at the start of mark formation operation are deleted from the timing chart of FIG. 7.

FIG. 8 is a timing chart of the image formation area signals in which the non-writing periods produced at the start of mark formation operation are deleted from the timing chart of FIG. 7.

In the timing chart of FIG. 7, the color of the mark image which is formed earliest is K which is arranged at the head-end one of the mark formation areas. In this case, it is supposed that the condition a>b is satisfied and the sequence of the color components of the toner marks in the sub-scanning direction is a reversal of the sequence of the color components of the color component images transferred by the image formation parts in the sub-scanning direction.

Therefore, the mark images of other colors are not formed until the mark image of K is formed following the start of mark formation operation. That is, the period 3*b* (which is set up as the delay time of K in FIG. 7) is deleted from the total period, and the start time for mark formation of each color is brought forward by a time equivalent to 3*b*.

FIG. 8 shows this result. The formation of the mark image of K is started immediately when the mark formation operation is started. At the time of end of formation of the M mark image of the last timing, the mark formation operation is completed. The time required is set to "4*a*–3*b*". In this embodiment, the time required can be further shortened by a time equivalent to 3*b* when compared with the example of FIG. 7.

Generally speaking, when a>b, the processing of forming the correction pattern images for each of the color components is started earlier than in the normal printing mode by a time equivalent to b(n−1) where n is the number of the color components.

Similar to the above-mentioned embodiment (FIG. 8), the following embodiment is adapted to delete the non-writing periods produced at the time of start of mark formation operation, thereby shortening the time required.

In the present embodiment, the sequence of the color components of the toner marks in the sub-scanning direction is a reversal of the sequence of the color components of the color component images transferred by the image formation parts in the sub-scanning direction, which is the same as the case in the previous embodiment (FIG. 8). However, in the present embodiment, the condition a<b is satisfied, which is a reversal of the relation between "a" and "b" in the case of the previous embodiment (FIG. 8).

Figure 9:
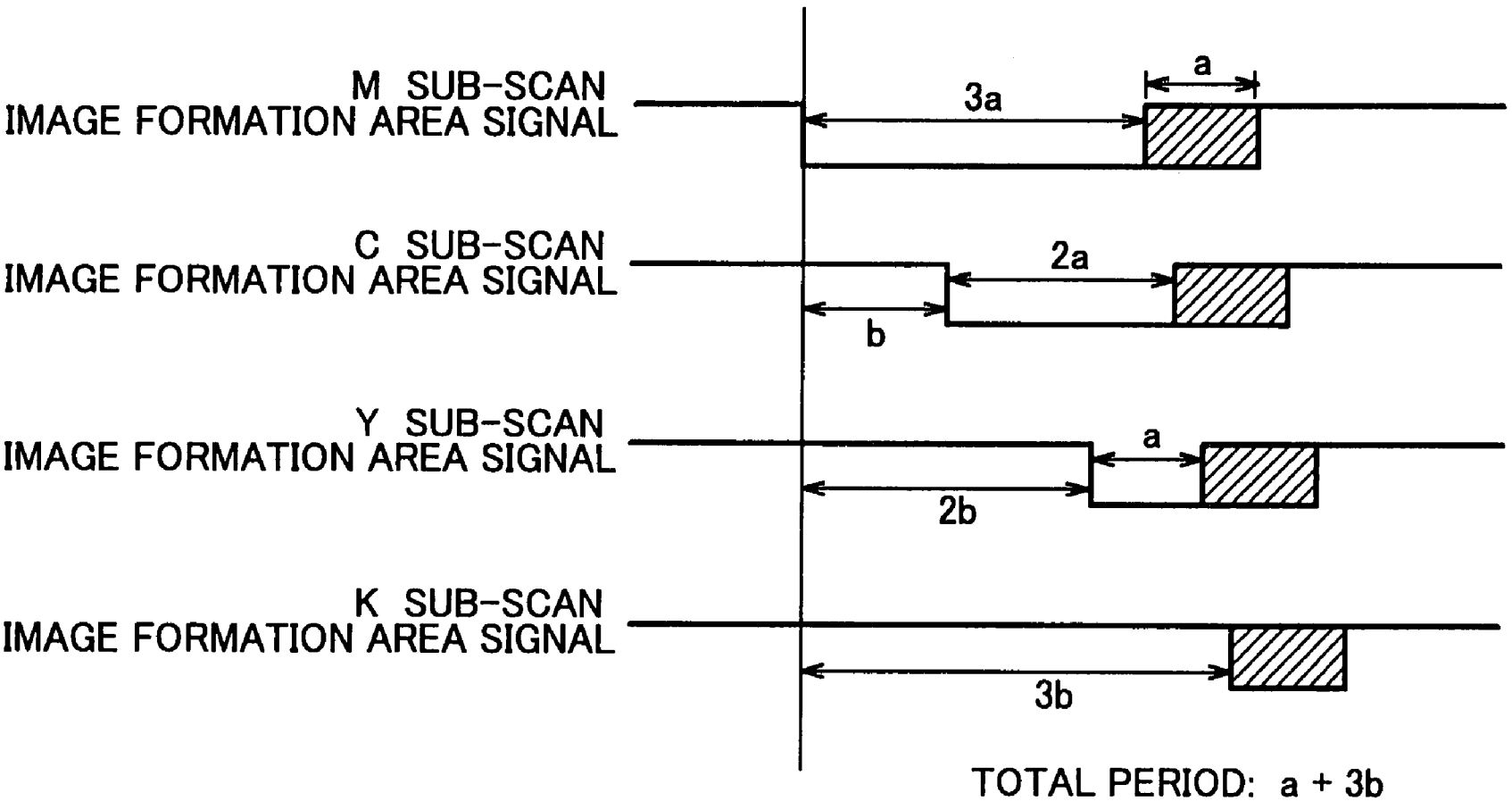
FIG. 9 is a timing chart of the image formation area signals for explaining mark formation operation ($a<b$) which deactivates the image writing of the respective colors.

FIG. 9 is a timing chart of the image formation area signals for explaining the mark formation operation (a<b) which deactivates the image writing of the respective colors. In the timing chart of FIG. 9, the non-writing periods produced at the start of mark formation operation are not yet deleted.

In the timing chart of FIG. 9, the M mark image is formed earliest. The mark images of other colors are not formed until the formation of the M mark image is completed following the start of the mark formation operation. That is, the period 3*a* (which is set up to assign the last mark formation area) is deleted from the total period, and the start time for mark formation of each color is brought forward by a time equivalent to 3*a*.

Figure 10:
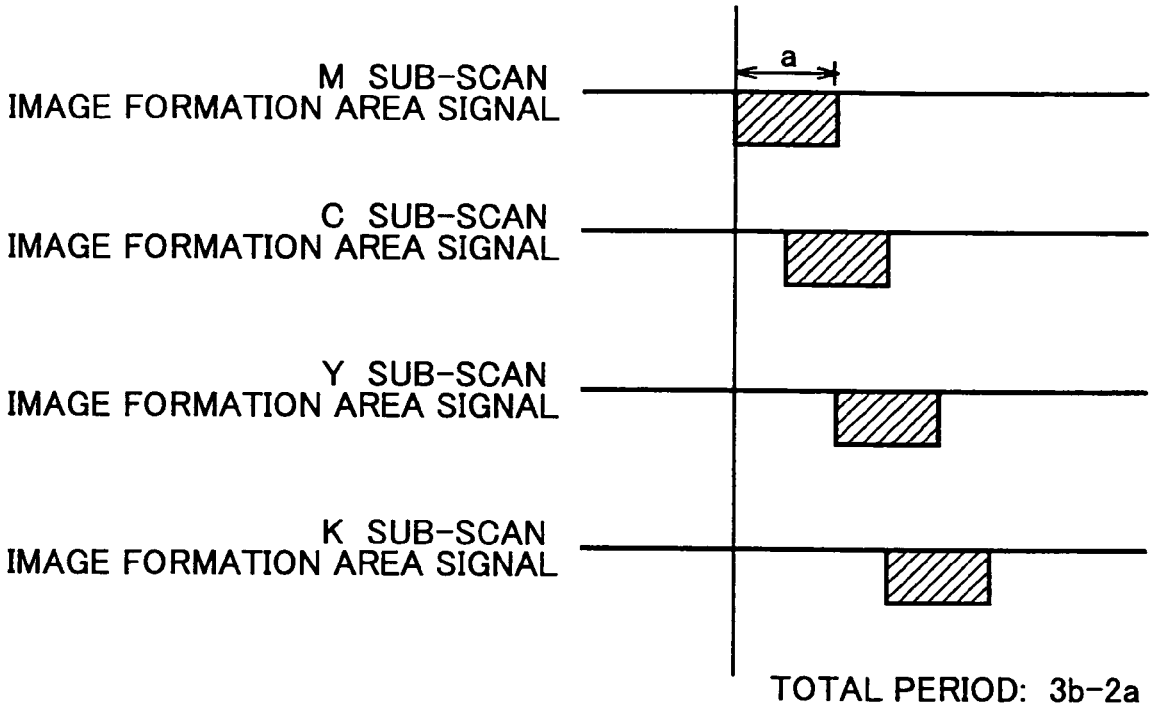
FIG. 10 is a timing chart of the image formation area signals in which the non-writing periods at the start of mark formation operation are deleted from the timing chart of FIG. 9.

FIG. 10 shows this result. The formation of the mark image of M is started immediately when the mark formation operation is started, and at the time of end of formation of the K mark image of the last timing, the mark formation operation is completed. The time required is set to "3*b*–2*a*". In this embodiment, the time required can be further shortened by a time equivalent to 3*a* when compared with the example of FIG. 9.

Generally speaking, when a<b, the processing of forming the correction pattern images for each of the color components is started earlier than in the normal printing mode by a time equivalent to a(n−1) where n is the number of the color components.

The present invention is not limited to the above-described embodiments, and variations and modifications may be made without departing from the scope of the present invention.

Further, the present application is based on and claims the benefit of priority of Japanese patent application No. 2005-222813, filed on Aug. 1, 2005, the entire contents of which are hereby incorporated by reference.

What is claimed is:

1. A color image forming device comprising:

a plurality of first image support mediums of respective color components each adapted to support a color component image on a photoconductor surface respectively;

a scanning exposure unit adapted to output a scanning light beam, generated in accordance with a line image signal of a main scanning direction, to each of the photoconductor surfaces of the color components of the first image support mediums at a predetermined cycle while the photoconductor surfaces are moved in a sub-scanning direction perpendicular to the main scanning direction, so that a two-dimensional color-component image is formed on each photoconductor surface by exposure to the scanning beam light;

a second image support medium adapted to receive the color component images transferred from the first image support mediums of the respective color components to support a color composite image produced by the received color component images;

a second image support medium transport unit transporting the second image support medium through image transfer positions of the respective color components in synchronization with movement of the first image support mediums of the respective color components in the sub-scanning direction;

a transfer unit transferring the color component images from the first image support mediums of the color components to the second image support medium;

a correction-pattern-image forming unit controlling the scanning exposure unit to form correction pattern images, each adapted for correcting the image formation operating states for the color component concerned, in predetermined areas arrayed on the seocond image support medium in the sub-scanning direction;

a pattern measurement unit measuring the correction pattern images formed on the second image support medium by the correction-pattern-image forming unit; and a control unit correcting the image formation operating states for the respective color components in accordance with a result of the measurement of the pattern measurement unit to control image formation operation of the color image forming device, wherein "a" is the length of a correction pattern image in the sub-scanning direction, "b" is the distance between adjacent image transfer positions of the respective color components in the sub-scanning direction, and the correction pattern image forming unit is arranged so that, when a>b, at completion of formation of a correction pattern image on the first image support medium of the color component which is the first in a sequence of the color components in the sub-scanning direction, write-enable signals for forming correction-pattern images on the first image support mediums of the other color components are deactivated.

2. The color image forming device according to claim 1 wherein the correction-pattern-image forming unit is configured to start processing of forming the correction pattern images on the second image support medium immediately when one of the color component images corresponding to the correction pattern images is formed on a corresponding one of the first image support mediums at an earliest timing among the color component images.

3. The color image forming device according to claim 1 wherein the correction-pattern-image forming unit is configured so that a sequence of the color components of the correction pattern images formed by the correction-pattern-image forming unit in the sub-scanning direction is a reversal of a sequence of the color components of the color component images transferred by the transfer unit in the sub-scanning direction.

4. The color image forming device according to claim 3 wherein, when a length a of each of the correction pattern images is smaller than a pitch b between two adjacent ones of the plurality of first image support mediums, processing of forming the correction pattern images for each of the color components is started earlier than in a normal printing mode by a time equivalent to a(n−1) where n is the number of the color components.

5. The color image forming device according to claim 1 wherein the correction-pattern-image forming unit is configured to terminate processing of forming the correction pattern images immediately when a final one of the correction pattern images is formed on the second image support medium.

6. The color image forming device according to claim 1 wherein the correction pattern images are used for correction of image formation process conditions.

7. The color image forming device according to claim 1 wherein the correction pattern images are used for correction of color matching conditions of each color component.

8. The color image forming device according to claim 1 wherein the correction pattern images are used for correction of drive phase conditions of the first image support medium of each color component.

9. A color image forming device comprising:

a plurality of first image support mediums of respective color components each adapted to support a color component image on a photoconductor surface respectively;

a scanning exposure unit adapted to output a scanning light beam, generated in accordance with a line image signal of a main scanning direction, to each of the photoconductor surfaces of the color components of the first image support mediums at a predetermined cycle while the photoconductor surfaces are moved in a sub-scanning direction perpendicular to the main scanning direction, so that a two-dimensional color-component image is formed on each photoconductor surface by exposure to the scanning beam light;

a second image support medium adapted to receive the color component images transferred from the first image support mediums of the respective color components to support a color composite image produced by the received color component images;

a second image support medium transport unit transporting the second image support medium through image transfer positions of the respective color components in synchronization with movement of the first image support mediums of the respective color components in the sub-scanning direction;

a transfer unit transferring the color component images from the first image support mediums of the color components to the second image support medium;

a correction-pattern-image forming unit controlling the scanning exposure unit to form correction pattern images, each adapted for correcting the image formation operating states for the color component concerned, in predetermined areas arrayed on the second image support medium in the sub-scanning direction;

a pattern measurement unit measuring the correction pattern images formed on the second image support medium by the correction-pattern-image forming unit; and a control unit correcting the image formation operating states for the respective color components in accordance with a result of the measurement of the pattern measurement unit to control image formation operation of the color image forming device, wherein the correction-pattern-image forming unit is configured to form a correction pattern image, with the color component coming first in sequence in the sub-scanning direction, in a position on the second image support medium that follows the position of a correction pattern image formed by another color component as the second image support medium moves in the sub-scanning direction, the correction-pattern-image forming unit is configured so that a sequence of the color components of the correction pattern images formed by the correction-pattern-image forming unit in the sub-scanning direction is a reversal of a sequence of the color components of the color component images transferred by the transfer unit in the sub-scanning direction, and when a length a of each of the correction pattern images is larger than a pitch b between two adjacent ones of the plurality of first image support mediums, processing of forming the correction pattern images for each of the color components is started earlier than in a normal printing mode by a time equivalent to b(n−1) where n is the number of the color components.

* * * * *